US007191604B1

(12) United States Patent
Wiggs

(10) Patent No.: US 7,191,604 B1
(45) Date of Patent: Mar. 20, 2007

(54) HEAT PUMP DEHUMIDIFICATION SYSTEM

(75) Inventor: B. Ryland Wiggs, Franklin, TN (US)

(73) Assignee: Earth To Air Systems, LLC, Franklin, TX (US)

( * ) Notice: Subject to any disclaimer, the term of this patent is extended or adjusted under 35 U.S.C. 154(b) by 0 days.

(21) Appl. No.: 10/815,530

(22) Filed: Apr. 1, 2004

Related U.S. Application Data

(60) Provisional application No. 60/547,979, filed on Feb. 26, 2004.

(51) Int. Cl.
*F25D 17/06* (2006.01)

(52) U.S. Cl. ..... 62/89; 62/324.1

(58) Field of Classification Search ..... 62/90, 62/160, 173, 176.1, 176.5, 208, 324.1, 324.6, 62/89, 92, 93, 324; 236/44 C; 165/240
See application file for complete search history.

(56) References Cited

U.S. PATENT DOCUMENTS

| | | | | | |
|---|---|---|---|---|---|
| 3,986,345 | A | * | 10/1976 | Pilz et al. | 62/238.6 |
| 4,182,133 | A | * | 1/1980 | Haas et al. | 62/93 |
| 4,189,848 | A | * | 2/1980 | Ko et al. | 34/473 |
| 4,224,805 | A | | 9/1980 | Rothwell | 62/260 |
| 4,378,787 | A | | 4/1983 | Fleischmann | 126/430 |
| 4,544,021 | A | | 10/1985 | Barrett | 165/45 |
| 4,700,550 | A | * | 10/1987 | Rhodes | 62/271 |
| 4,741,388 | A | | 5/1988 | Kuroiwa | 165/45 |
| 4,993,483 | A | | 2/1991 | Harris | 165/45 |
| 5,062,276 | A | * | 11/1991 | Dudley | 62/176.6 |
| 5,105,633 | A | * | 4/1992 | Briggs | 62/434 |
| 5,131,238 | A | * | 7/1992 | Meckler | 62/271 |
| 5,275,008 | A | * | 1/1994 | Song et al. | 62/81 |
| 5,381,672 | A | * | 1/1995 | Haasis | 62/458 |
| 5,461,876 | A | | 10/1995 | Dressler | 62/160 |
| 5,598,887 | A | * | 2/1997 | Ikeda et al. | 165/202 |
| 5,622,057 | A | * | 4/1997 | Bussjager et al. | 62/173 |
| 5,623,986 | A | | 4/1997 | Wiggs | 165/45 |
| 5,671,608 | A | * | 9/1997 | Wiggs et al. | 62/260 |
| 5,738,164 | A | | 4/1998 | Hildebrand | 165/45 |
| 5,771,700 | A | | 6/1998 | Cochran | 62/117 |
| 5,816,314 | A | | 10/1998 | Wiggs et al. | 165/45 |
| 5,946,928 | A | | 9/1999 | Wiggs | 62/260 |

(Continued)

FOREIGN PATENT DOCUMENTS

| | | | | |
|---|---|---|---|---|
| JP | 10-58965 | A | * | 3/1998 |

(Continued)

*Primary Examiner*—Mohammad M. Ali
(74) *Attorney, Agent, or Firm*—Waddey & Patterson, P.C.; Phillip E. Walker; Mark J. Patterson

(57) ABSTRACT

A heat pump dehumidification system comprised of one of an air source heat pump system, a water source heat pump system, and a direct expansion heat pump system, with an extra interior air heat exchange means situated between the system's compressor's hot refrigerant gas discharge side and the exterior heat exchange means, for activation and use in conjunction with the system's primary interior air heat exchange means, located between the exterior heat exchange means and the system's compressor's refrigerant gas suction side, when operation in a dehumidification mode is desired absent sensible cooling, and optimum design sizes for both interior air exchange means while the system is operating in one of a dehumidification mode, a cooling mode, and a heating mode.

31 Claims, 3 Drawing Sheets

U.S. PATENT DOCUMENTS 5,992,160 A * 11/1999 Bussjager et al. ..... 62/79
6,212,892 B1 * 4/2001 Rafalovich ..... 62/90
6,216,484 B1 * 4/2001 Yun ..... 62/325
6,295,825 B1 * 10/2001 Jin ..... 62/238.7
6,615,601 B1 9/2003 Wiggs ..... 62/235.1
6,826,921 B1 * 12/2004 Uselton ..... 62/176.6

FOREIGN PATENT DOCUMENTS

JP 2000-52748 A * 2/2000
JP 2002-18228 A * 1/2002

* cited by examiner

HEAT PUMP DEHUMIDIFICATION SYSTEM

This application claims priority to co-pending U.S. patent application Ser. No. 60/547,979 filed Feb. 26, 2004, entitled "Deep Well Direct Expansion System Dehumidifier", which is hereby incorporated by reference in its entirety.

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Be it known that I, B. Ryland Wiggs, a citizen of the United States, residing at 425 Sims Lane, Franklin, Tenn. 37069, have invented a new and useful "Heat Pump Dehumidification System."

BACKGROUND OF THE INVENTION

The present invention relates to an improved heat pump dehumidification system, consisting of at least one of an air source heat pump, a water source heat pump, and a direct expansion heat pump, incorporating a unique combination of an additional interior heat exchange means (typically an air handler) for use when the system has satisfied the thermostat setting in the cooling mode of operation, but when humidity levels remain excessively high, as well as an optimum design sizing for a heat pump system's interior air heat exchange means while operating in one of a dehumidification mode, a cooling mode, and a heating mode.

Air source heat pump systems typically circulate a refrigerant, such as R-22 or the like, as a means to extract heat from the exterior air in the heating mode of operation, and as a means to reject heat into the exterior air in the cooling mode of operation. An electric fan typically enhances the circulation of air over a first array of exterior finned heat exchange tubing exposed to the exterior air. Having gained heat from, or rejected heat into, the exterior air, the heated or cooled refrigerant is then circulated, by means of a refrigerant compressor, through the refrigerant transport tubing into a second array of finned heat exchange tubing, with airflow augmented by means an electric fan, located within the interior space, with a second heat exchange step comprising a transfer of heat to or from the refrigerant to heat or cool interior air space, depending on the direction of the flow of refrigerant in the heating mode or in the cooling mode. The operation of an air source heat pump is well understood by those skilled in the art.

Rather than using exterior air as an exterior heat exchange means, ground source/water source heat pump systems typically utilize fluid-filled closed loops of tubing buried in the ground, or submerged in a body of water, so as to either absorb heat from, or to reject heat into, the naturally occurring geothermal mass and/or water surrounding the buried or submerged tubing. Water-source heating/cooling systems typically circulate, via a water pump, water, or water with anti-freeze, in plastic underground geothermal tubing so as to transfer heat to or from the ground, with a second heat exchange step utilizing a refrigerant, such as R-22 or the like, to transfer heat to or from the water, and with a third heat exchange step utilizing an array of interior finned refrigerant transport tubing, with airflow augmented by an electric fan, to transfer heat to or from the refrigerant to heat or cool interior air space. The operation of a water source heat pump is well understood by those skilled in the art.

Direct eXpansion (herein referred to as "DX") ground source systems, where the refrigerant transport lines are placed directly in the sub-surface ground and/or water, typically circulate a refrigerant fluid, such as R-22, in sub-surface refrigerant lines, typically comprised of copper tubing, to transfer heat to or from the sub-surface elements, and only require a second heat exchange step to transfer heat to or from the interior air space by means of the interior air's exposure to an array of finned heat transfer tubing, with the interior's air flow augmented by an electric fan.

Consequently, DX systems are generally more efficient than water-source systems because of less heat exchange steps and because no water pump energy expenditure is required. Further, since copper is a better heat conductor than most plastics, and since the refrigerant fluid circulating within the copper tubing of a DX system generally has a greater temperature differential with the surrounding ground than the water circulating within the plastic tubing of a water-source system, generally, less excavation and drilling is required, and installation costs are generally lower with a DX system than with a water-source system.

Also, since DX systems do not require a defrost cycle in the heating mode, and since the sub-surface geothermal heat exchange temperatures are far more stable than those of widely fluctuating exterior air in ever-changing atmospheric conditions, DX systems are generally more efficient than air source systems.

While most in-ground/in-water heat exchange designs are feasible, various improvements have been developed intended to enhance overall system operational efficiencies in DX heat pumps. Various such design improvements are taught in U.S. Pat. No. 5,623,986 to Wiggs; in U.S. Pat. No. 5,816,314 to Wiggs, et al.; in U.S. Pat. No. 5,946,928 to Wiggs; in U.S. Pat. No. 6,615,601 B1 to Wiggs; in Wiggs' U.S. patent application Ser. No. 10/073,513; in Wiggs' U.S. patent application Ser. No. 10/127,517; in Wiggs' U.S. patent application Ser. No. 10/251,190; in Wiggs' U.S. patent application Ser. No. 10/335,514; in Wiggs' U.S. patent application Ser. No. 10/616,701, in Wiggs' U.S. patent application Ser. No. 10/757,265, and in Wiggs's U.S. patent application Ser. No. 10/804,698, the disclosures of which are incorporated herein by reference.

Since DX heat pump applications are generally the most efficient types of heat pumps, and since the interior air heat exchange means is basically the same for all heat pump systems, only the best heat pump design will be demonstrated herein, although the subject invention can be utilized in an identical manner for all heat pump systems, whether air source, water source or DX.

Virtually all heat pump systems utilize a compressor, an interior heat exchange means, an exterior heat exchange means, thermal expansion devices, an accumulator, a refrigerant fluid (such as R-22, R-410A, or the like), and operatively connected refrigerant transport tubing, as is well understood by those skilled in the art. Also, most all heat pump systems utilize an interior air handler, comprised of an array of finned refrigerant transport tubing with airflow augment by an electric fan, as the interior heat exchange means, as is well understood by those skilled in the art. However, occasionally, the interior heat exchange means may be comprised of a refrigerant to water heat exchange means, with the water circulated within the interior space, which is commonly referred to as a hydronic type interior heat exchange means, as is well understood by those skilled in the art.

As explained, virtually all heat pump systems utilize an array of finned refrigerant transport tubing, with the interior airflow passing over same augmented by means of an electric fan, which is commonly referred to as an air handler. As the interior air passes over the finned tubing, the air absorbs heat from the hot refrigerant in the heating mode, and rejects heat into the cold refrigerant in the cooling mode. The air handler may be comprised of one or multiple sets of arrays of finned refrigerant transport tubing, and the air handler's electric fan may be designed to operate at one or at multiple speeds. All of this is well understood by those skilled in the trade.

While virtually all heat pump systems operate in a reverse-cycle mode, and may be switched from a heating mode to a cooling mode, and vice versa, by simply changing the setting on the system's thermostat, as is well understood by those skilled in the art, the present invention is principally concerning the operation of heat pump systems in the cooling mode.

When operating in the cooling mode, cold refrigerant is circulated through the interior air handler, with the warmer interior air being blown over the cold finned refrigerant transport tubing by means of an electric fan. Heat is absorbed by the cold refrigerant, as heat always travels to cold, and is thereby removed from the interior air. The removal of heat is commonly referred to as the sensible load work performed by the system. However, in the cooling mode of operation, a second consequence of the heat pump's operation occurs. Namely, naturally occurring moisture in the interior air is also removed. This removal of moisture, which is commonly referred to as the latent load work performed by the system, results because the cold refrigerant is below the dewpoint. Consequently, when operating in the cooling mode, all heat pump systems' interior heat exchange means are equipped with a moisture condensate drain to remove the condensed moisture from the interior space. Typically, the condensate drain consists of a PVC tube, or the like, which typically simply carries the water to the exterior of the house via gravity. If the condensate water must travel uphill to be removed, such as from a basement area, a small condensate water pump, electrically operated, is situated at a low point within the condensate drain line to pump the water out of the structure. All of the above is well understood by those skilled in the art, and consequently, the condensate drain is not shown herein.

In many areas, excessive moisture can create health concerns, such as fostering molds and dust mites, as well as decreasing comfort levels. While heat pump systems do remove moisture from the interior air when operating in the cooling mode, as explained above, heat pump systems do not remove moisture from the air when the thermostat is satisfied and the system is inoperative, as heat pump systems are virtually always solely designed to provide thermostatic sensible load comfort levels without regard to interior latent load humidity levels. The removal of excessive interior humidity has simply been an historical advantageous by-product of the heat pump system while it is operating in the cooling mode.

In areas where high humidity levels can cause discomfort and/or associated health concerns from mold accumulation and the like, the removal of high levels of humidity is desirous. It is reported that data released by the American Society of Heating, Refrigerating and Air-Conditioning Engineers ("ASHRAE") suggests that maintaining relative humidity levels between 30% and 60% limits the harmful effects of many unwanted bacteria, viruses, fungi, mites, allergic rhinitis and asthma, and other respiratory related conditions. It is reported that The Journal of Allergy and Clionical Immunology has recommended that interior relative humidity levels be maintained below 51% to inhibit dust mites and to improve healthfulness.

While all refrigerant based heat pump cooling equipment generally removes humidity, the cooler the refrigerant the more humidity that is removed. However, historically, as explained, humidity is only removed when the heat pump's cooling system is operating. When the system's thermostat setting is reached, typically at about 70 degrees F., the cooling system typically shuts off until the interior air warms enough to register at the thermostat and to thereby re-engage the cooling system. When the cooling system is shut off, the system's compressor and interior air handler both are typically shut off, thereby stopping both the sensible cooling of the interior air and the associated latent load removal of interior air humidity, as there is no air flow over the cold refrigerant within the finned heat exchange tubing of the interior air handler.

In order to continuously remove humidity with conventionally designed systems, one must continuously operate the system in the cooling mode. Such continuous operation typically results in excessive cooling, to the point of being uncomfortably cold. While one could continuously operate a small cooling system in an effort to continuously remove humidity, and engage a larger cooling system only when the small unit could not remove the interior heat load, during cooler nighttime periods even the small cooling system could still make the interior space uncomfortably cold. Further, smaller systems may not have the ability to remove large amounts of humidity present when the primary larger cooling system is shut off.

Historically, excessive humidity levels are addressed by the utilization of a dehumidifier, which dehumidifier is a system totally separate and independent of a heat pump system, as is well understood by those skilled in the trade. However, traditional dehumidifiers are not particularly efficient to operate, require additional space, do not have the typically higher design load capacities of heat pump systems, and often require the owner to manually dispose of trays of accumulated water.

Since excessively high humidity levels can be both uncomfortable as well as a health concern, particularly with the requisite introduction of certain quantities of fresh air into schoolrooms and the like, a means to utilize existing heat pump systems to expressly remove excessive humidity, exclusive of the thermostat level, and without the need to operate a totally separate and independent dehumidification system is desirable.

Thus, it is an objective of this subject invention to disclose a means to utilize existing heat pump systems for dehumidification purposes, exclusive of the need to obtain and operate a separate and independent dehumidification system, and exclusive of the need to solely rely upon heat pump system operation in the cooling mode controlled by a thermostat.

SUMMARY OF THE INVENTION

It is an object of the present invention to further enhance and improve the humidity removal qualities of predecessor heat pump system designs by means of teaching the addition of a secondary interior air heat exchange means, designed to neutralize the thermostatic cooling effect of a heat pump system operating in the cooling mode once the thermostat's cooling set point has been satisfied, while simultaneously allowing the heat pump system to operate and to remove excessive humidity based upon desired humidistat control settings. Thus, a heat pump dehumidification system is disclosed comprised of one of an air source heat pump system, a water source heat pump system, and a direct expansion heat pump system, with an extra interior air heat exchange means situated between the system's compressor's hot refrigerant gas discharge side and the exterior heat exchange means, for activation and use in conjunction with the system's primary interior air heat exchange means, located between the exterior heat exchange means and the system's compressor's refrigerant gas suction side, when operation in a dehumidification mode is desired absent sensible cooling.

Refrigerant system design components are all operatively connected via refrigerant transport tubing, as is well understood by those skilled in the art. Virtually all heat pump systems described herein are electrically powered. Electrical power lines and electrical connections are not shown herein as they are well understood by those skilled in the art. All refrigerant transport tubing referenced is sized for refrigerant grade copper tubing, which sizing/dimensions are well understood by those skilled in the art. All calculations of cooling loads are made via conventional ACCA Manuel J load calculations, or other similar conventional load design criteria. Cooling load designs are typically calculated in tonnage design capacities, where 12,000 BTUs equal one ton of design capacity. ACCA Manuel J heating/cooling load calculations are well understood by those skilled in the art.

Virtually all heat pump systems are comprised of at least a refrigerant, refrigerant transport tubing, a compressor, interior heat exchange means, and exterior heat exchange means, as is well understood by those skilled in the art. Additionally, virtually all heat pump systems are additionally comprised of refrigerant expansion valves, check vales, an accumulator, an optional receiver, an optional oil separator, sight glasses, and the like, as is additionally well understood by those skilled in the art.

As has been disclosed in the aforesaid Wiggs' U.S. patent application Ser. No. 10/757,265, which Application is incorporated herein by reference, a highly efficient means of geothermal heating and cooling was taught.

Testing has also shown that, when operating in the cooling mode, the said DX system removes significantly more humidity than other conventional cooling systems because the refrigerant, being cooled in the approximate 55 degree F. earth, is cooler and further below the dew-point than the refrigerant being cooled by other means, such as by 70 degree F. to 100 degree F. outdoor air in an air-source heat pump for example. Further, unlike most other conventional heat pump designs, which are well understood by those skilled in the art, DX heat pump systems are capable of maintaining humidity levels below 50%. Thus, while the subject invention may be utilized in conjunction with any heat pump system, use of the subject invention in conjunction with a DX system design is shown herein, as this would render the best preferred results.

To take advantage of the highly efficient refrigerant cooling properties of a DX heat pump system, as well as to take advantage of the cooling properties of any heat pump system, as a sole means of humidity removal, a means of removing unwanted humidity must be found which would permit continued operation of the DX or other heat pump system once the desired cooling thermostat setting has been reached, all without excessively cooling the interior air. Such a means may be accomplished by rejecting all, or a significant portion, of the heat removed by the heat pump system, when operating in the cooling mode, back into the interior air instead of into one of the ground (with a DX system), water circulated in the ground (with a water-source system), and air (with an air source system), by means of a secondary interior heat exchange means (typically an air handler) located on the hot gas refrigerant side of the compressor, prior to the exterior heat exchange means, when the system is operating in the cooling mode.

Thus, the airflow may be continuously maintained over the cold refrigerant tubing within the heat pump system's primary interior air handler, located between the system's exterior heat exchange means and the compressor's suction intake side, thereby condensing and removing humidity from the interior air, all while the interior air maintains a relatively constant temperature by means of the heat, which has been removed from the interior air via refrigerant circulating within the primary air handler, being rejected back into the interior air by means of the supplemental and secondary interior air heat exchange means (typically an air handler) situated on the hot vapor gas refrigerant discharge side of the compressor prior to the system's exterior heat exchange means.

More specifically, to accomplish this means of removing humidity once the heat pump system's thermostat setting has been reached, a secondary interior air handler would be placed within the refrigerant transport loop at a location between the system's compressor and one of the sub-surface heat exchange tubing, the refrigerant to circulating water to ground heat exchange loop, and the exterior air heat exchange loop, so as to transfer all or most of the heat removed by the first and primary cooling mode air handler back into the interior air before the heat is rejected into the exterior heat exchange means, which is comprised of one of the earth, water, and exterior air. The warmed air supplied by the secondary and additional air handler would temper the otherwise cooled air traveling through the return air ducts, so as to permit the system to remain in operation without cooling the interior air to so low a point as to call for the thermostat to become uncomfortably cool. Preferably, the cooled air and the warmed air would be mixed together within the supply ductwork, which is well understood by those skilled in the art, prior to the supply air being distributed into the interior air space by the supply air ducts. Further, since all or most (most means all, less the extra heat generated by means of the externally powered system components, such as the compressor, the fans, and the like) of the removed interior air heat is being replaced back into the interior air before it reaches at least one of the ground and the water in a geothermal system application, there is no undue heat load or stress placed upon the sub-surface heat exchange area or upon a geothermal heat pump system by means of an extended system operation in the dehumidification mode.

Generally, the operation of the heat pump system in the dehumidification mode can be accomplished by means of at least one of a thermostat and a humidistat, which either activates solenoid valves to direct refrigerant fluid through the secondary interior air heat exchange means (air handler), or, absent the existence of solenoid valves controlling the flow of refrigerant fluid through one of the air handler and an air handler by-pass refrigerant transport line when dehumidification mode operation is not desired, activates the fan in the secondary air handler. The manner of wiring one of a thermostat and a humidistat so as to operate one of solenoid valves and a fan motor is well understood by those skilled in the art.

While a standard sized DX system could be continuously operated in a dehumidification mode, even after the thermostat called for the primary cooling mode to shut off, by means of engaging the secondary air handler via solenoid valves (solenoid valves are well understood by those skilled in the art) or the like, such a continuous operation of the primary DX system compressor would likely be unnecessary in most situations since operation of the full heat pump system in a dehumidification mode will remove far more humidity in much less time than conventional and smaller dehumidifiers.

Desirable dehumidification mode system operation can be controlled by a humidity sensor in a manner similar to that of a thermostat controlling temperature levels. Thus, if the thermostat was satisfied and the primary cooling system was not in operation (thereby normally ceasing to automatically remove humidity), but the humidity level remained at an unacceptably high level, the humidity sensor would engage the heat pump system in the dehumidification mode only, meaning the primary system would now fully operate in conjunction with the secondary air handler, restoring the removed sensible heat back into the interior air supply ducts, until a satisfactory humidity level was reached, at which point the entire system would shut off.

In heat pump systems with one of a single speed, a multiple speed, and a variable speed compressor, at least one of the thermostat and the humidity sensor (the humidity sensor is also called the "humidistat") would control the operation of the compressor at one of the desired speed(s), depending on the desired level of operation and upon the excessive amount of humidity present in the interior air. Similarly, the fans in both the primary and the secondary air handlers would be adjusted to automatically match the operational speed of the compressor at one of the available desired fan speed settings to effect the desired cubic feet per minute of airflow and corresponding desired level of heat exchange, as is well understood by those skilled in the art.

The secondary air handler should be sized to remove all the heat extracted from the interior air by the primary air handler operating in the cooling mode so as to maintain a neutral interior air temperature, with the additional heat generated by the operation of the system's compressor and fans still being rejected into the exterior heat exchange means comprised of one of the ground heat sink, the water to ground heat sink, and the exterior air heat sink. The rejection of such a minimal amount of system mechanical operational heat will not impose any undue stress upon a geothermal system's sub-surface heat exchange field, will not impose any stress upon an air source system's exterior air heat exchange means, and will prevent the interior air from becoming too warm too soon.

The subject humidity removal design may be utilized with any geothermal DX system, with any geothermal water-source system, and with any air source heat pump system, although as stated, due to the typically colder refrigerant levels produced in the cooling mode by a DX system, the utilization of a DX system would typically be preferable. The colder the refrigerant in the cooling mode, the further the refrigerant temperature is below the dewpoint, and the greater the ability to efficiently remove excessive interior humidity. While most air source and water source heat pumps can be limited to a maintenance of humidity levels at 50%, or greater, a properly sized/designed DX system, due to its greater geothermal heat exchange temperature differential, can typically maintain humidity levels below 50%. Therefore, as stated, a DX heat pump system dehumidification system is generally preferred.

To effect an operational heat pump system, customary heat pump refrigerant system apparatus and materials would be utilized, such as a compressor, a refrigerant, refrigerant transport tubing, an accumulator, an optional receiver, an optional oil separator, a reversing valve to change the direction of the refrigerant flow (except through the accumulator and compressor) when a reverse-cycle system is switched from a heating mode to a cooling mode and vice versa, distributors when multiple refrigerant transport lines are utilized, a thermostat, wiring, controls, refrigerant tube couplings, check valves, optional solenoid valves, sight glasses, filter dryers, above-ground refrigerant transport line insulation (such as rubatex, or the like), a power source, a thermostat, and the like, all of which are well-known to those skilled in the art and therefore are not necessarily all shown herein. Both the operation and use of a thermostat and a humidistat, as well as their respective wiring, as well as the operation and use of a combined thermostat/humidistat and its wiring, to respectively control the operation of a cooling system and of a dehumidification system are well understood by those skilled in the art and are not shown herein. An example of a combined thermostat/humidistat capable of controlling the subject heat pump dehumidification system invention is a thermostat/humidistat model number IF95-391, manufactured by White Rogers, of 9797 Revis Road, Affton, Mo. 63123.

There is an additional advantage of utilizing a secondary interior air heat exchange means (second air handler) for optional dehumidification purposes. Namely, the incorporation of the second air handler in the hot gas line enables one to downsize the second air handler so as to gain warmer air in the heating mode, and simultaneously enables one to upsize the first and primary interior air heat exchange means (first air handler) so as to gain cooler air in the cooling mode and so as to remove more humidity in the dehumidification mode. Typically, in a reverse-cycle heat pump application, the standard one air handler is sized somewhere between the smaller heating mode optimum size and the larger cooling mode optimum size, so as to reasonably accommodate both operational modes.

For optimum system operational designs in most all heat pump systems, the first interior air heat exchange means, utilized for cooling mode operation (the first air handler), should be sized at a design capacity that is larger than the compressor design capacity, and typically preferably sized at 200%, plus or minus 10% of 100%, of the maximum compressor tonnage design capacity; and the second interior air heat exchange means, utilized for heating mode operation (the second air handler), should be sized at a design capacity that is equal to, or less than, the compressor design capacity, and typically preferably sized at 100%, plus or minus 10% of 100%, of the maximum compressor tonnage design capacity.

When operating in the dehumidification mode with a first air handler that is about twice the size of the second air handler, the airflow over both air handlers must still be equalized, less the rate in the second interior air heat exchange means (the second air handler) that is equivalent to the additional heat of compression generated by means of at least one of the system's compressor and externally powered components. The multiple manners of equalizing the airflow over both air handlers is well understood by those skilled in the art, and may, for one example, be easily accomplished by decreasing the fan speed, and resulting cubic feet per minute ("CFM") airflow, of the first air handler so as to match the desired CFM rate of the second air handler.

In such an enhanced cooling/dehumidification/heating mode operational system design, which is enabled by means of adding a secondary air handler in the manner as herein described, and where the second air handler is sized at about 50% of the first air handler, a secondary by-pass refrigerant transport line is preferably added around the first air handler for use in the heating mode of operation. The secondary by-pass line is operated by means of solenoid valves, or the like. A first solenoid valve, for example, is located prior to the refrigerant flowing through the self-adjusting thermal expansion device prior to the first air handler, and is in the open position so as to permit system operation in one of the cooling mode and the dehumidification mode. A second solenoid valve, located after the refrigerant has exited the first air handler, is in a closed position so as to prevent system operation in the heating mode. A control connecting wire, for example, connects the control box (the control box is comprised of a thermostat and a humidistat) with the open first solenoid valve; and a control connecting wire, for example, connects the control box with the closed second solenoid valve. As is well understood by those skilled in the art, one reversing valve, or the like, can be substituted for the two solenoid valves with the same effect of by-passing the desired air handler for system operation in one of the cooling mode and heating mode, or of not by-passing either air handler, for operation in the dehumidification mode. Also, the first air handler may be one of completely and mostly by-passed, while the system is operating in the heating mode, by various other alternative means other than by means of solenoid valves and a by-pass refrigerant transport line, as are well understood by those skilled in the art, such as, for example, by disengaging the first air handler's fan and thereby materially reducing the heat transfer over the first air handler's finned tubing.

BRIEF DESCRIPTION OF THE DRAWINGS

There are shown in the drawings embodiments of the invention as presently preferred. It should be understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
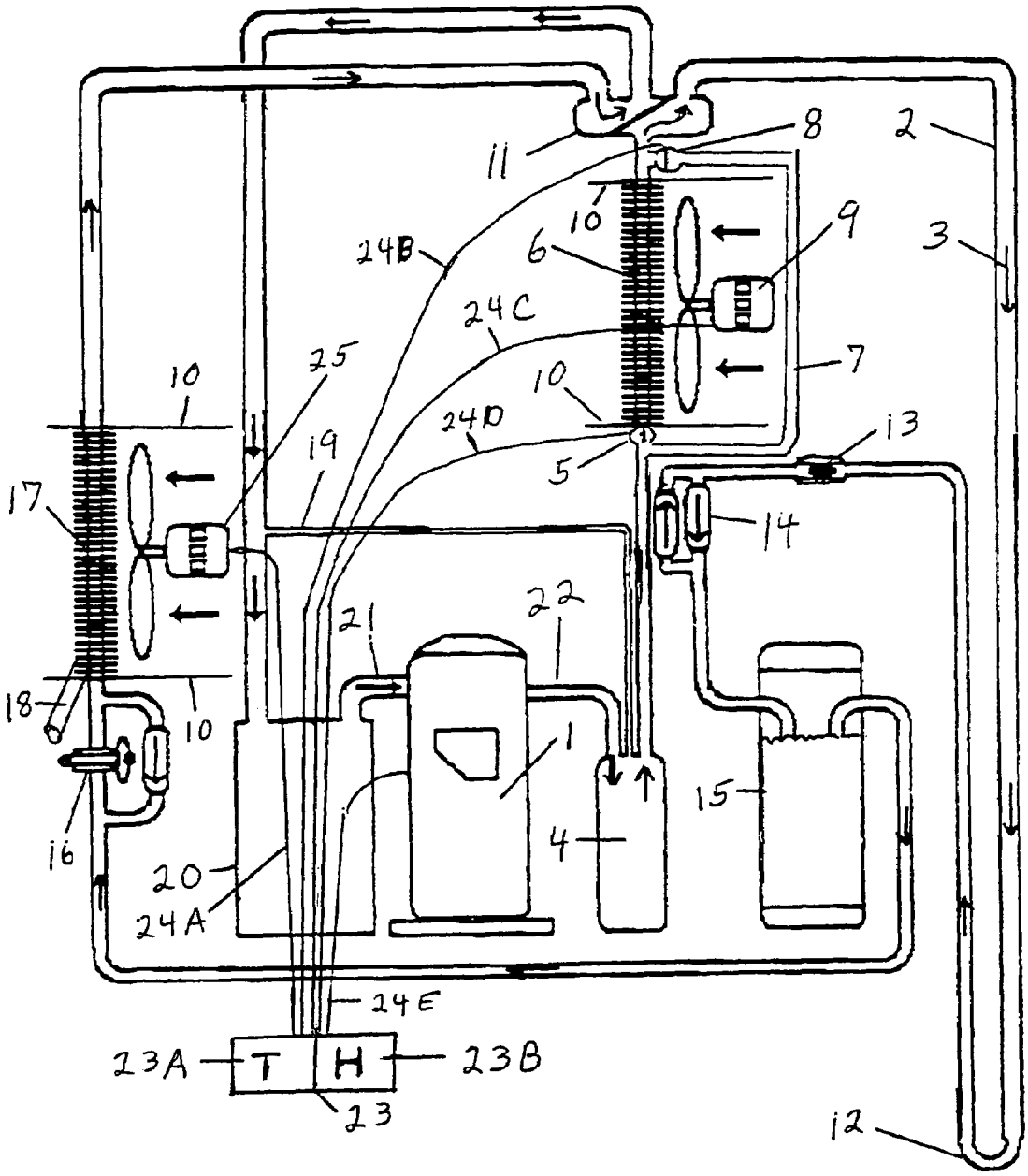
FIG. 1 is a side view of a deep well direct expansion heat pump system operating in the dehumidification mode, comprised of a compressor, a refrigerant (not shown as a refrigerant fluid flowing within the system is well understood by those skilled in the art), refrigerant transport lines, two interior air heat exchange means comprised of a first air handler and a second air handler, an exterior heat exchange means, and other system components common to a deep well direct expansion heat pump system.

Referring now to the drawings in detail, where like numerals refer to like parts or elements, there is shown in FIG. 1 a side view of a simple version of a deep well direct expansion geothermal heat pump system, operating in a dehumidification mode.

A refrigerant fluid (not shown) is transported, by means of a compressor's 1 force and suction, throughout the system and to/from various system components by means of refrigerant transport tubing 2. The directional flow of the refrigerant fluid within the refrigerant transport tubing 2 is shown by arrows 3 within the tubing 2.

The refrigerant flows from the compressor 1 through an oil separator 4, through an open first solenoid valve 5, and then through the secondary interior air heat exchange means (secondary air handler with finned tubing) 6, where most of the heat within the refrigerant fluid is transferred back into the interior air (not shown). In the cooling only mode of operation, and not in the dehumidification mode, the first solenoid vale 5 would be closed (not shown here as closed) and the refrigerant would flow through the by-pass line 7 and around the secondary air handler with finned tubing 6, and through the second solenoid valve 8, which is alternately shown here in a closed position so as to reflect dehumidification mode operation. In an alternative means of cooling only mode of operation, the first and second solenoid valves, 5 and 8, and the by-pass refrigerant transport line 7 could be entirely eliminated and the secondary air handler's 6 fan 9 could simply be disengaged, with no electrical power supplied to operate it, thereby preventing any material airflow through the ductwork 10 containing the secondary air handler 6.

The refrigerant next flows through the system's reversing valve 11, and down into the sub-surface geothermal exterior heat exchange means 12. Exiting the exterior heat exchange means 12, which has absorbed the minor amount of heat generated by the system's compressor 1 and fan 9, the refrigerant flows past a pin restrictor expansion device 13, for use in the heating mode of operation, through an open check valve 14, through a receiver 15, and through a self-adjusting thermal expansion device 16. The refrigerant then flows through the system's primary and first interior air heat exchange means (first air handler) 17, where the interior air is sensibly cooled and where latent load humidity is removed. The condensed humidity is drained away by means of a condensate drain line 18.

Lastly, the refrigerant flows from the primary and first air handler 17, through the reversing valve 11, past the oil return line from the oil separator 4, into the accumulator 20, where any liquid refrigerant is collected so as not to slug the compressor 1. The vapor refrigerant within the accumulator 20, which has absorbed heat from the interior air passing through the system's first air handler 17, is pulled into the compressor by means of the compressor's suction intake. The refrigerant is compressed by the compressor 1, and exits the compressor 1 by means of the compressor's 1 hot gas refrigerant vapor discharge line 22, where the entire process is repeated for as long as operation in the dehumidification mode is called for. The wiring of a control box 23, containing a temperature control/thermostat 23A and a humidity control/humidistat 23B, to operate the system in one of the cooling mode and the dehumidification mode is well understood by those skilled in the art and is not shown herein in detail. However, a control connecting wire 24A is shown connecting the control box 23, containing a thermostat 23A and a humidistat 23B, with the first air handler's 17 fan 25; a connecting wire 24B is shown connecting the control box 23 with the closed second solenoid valve 8; a connecting wire 24C is shown connecting the control box 23 with the second air handler's 6 fan 9; a connecting wire 24D is shown connecting the control box 23 with the open first solenoid valve 5; and a connecting wire 24E is shown connecting the control box 23 with the system's compressor 1.

Figure 2:
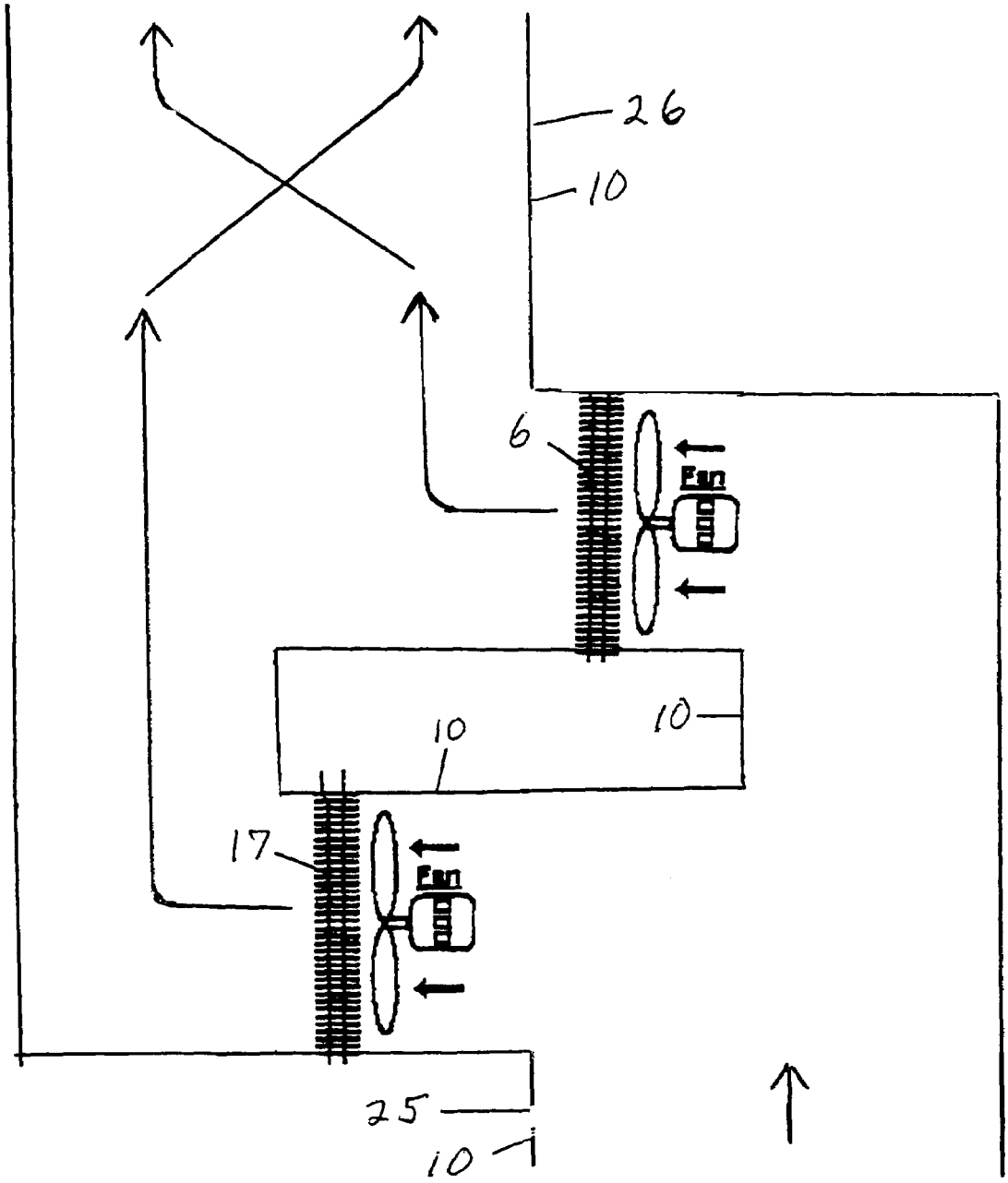
FIG. 2 is a side view of ductwork from both interior air handlers combining so as to mix the cooled and heated air, thereby neutralizing the cooling effect, prior to distribution into the interior air space by means of supply air ducts (not shown herein as supply air ducts are well understood by those skilled in the art).

FIG. 2 is a side view of ductwork 10, with the interior air directional flow shown by arrows 3 within the ductwork 10, entering both the first interior air handler 17 and the second interior air handler 6 from a common air return 25 ductwork 10. The interior air passes through both interior air handlers, 6 and 17, while the system is operating in the dehumidification mode, and then co-mingles as the interior air travels through the common air supply 26 ductwork 10, thereby neutralizing the cooling effect of the first air handler 17 prior to the interior air's distribution into the interior air space by means of individual air supply ducts (not shown herein as supply air ducts are well understood by those skilled in the art).

Figure 3:
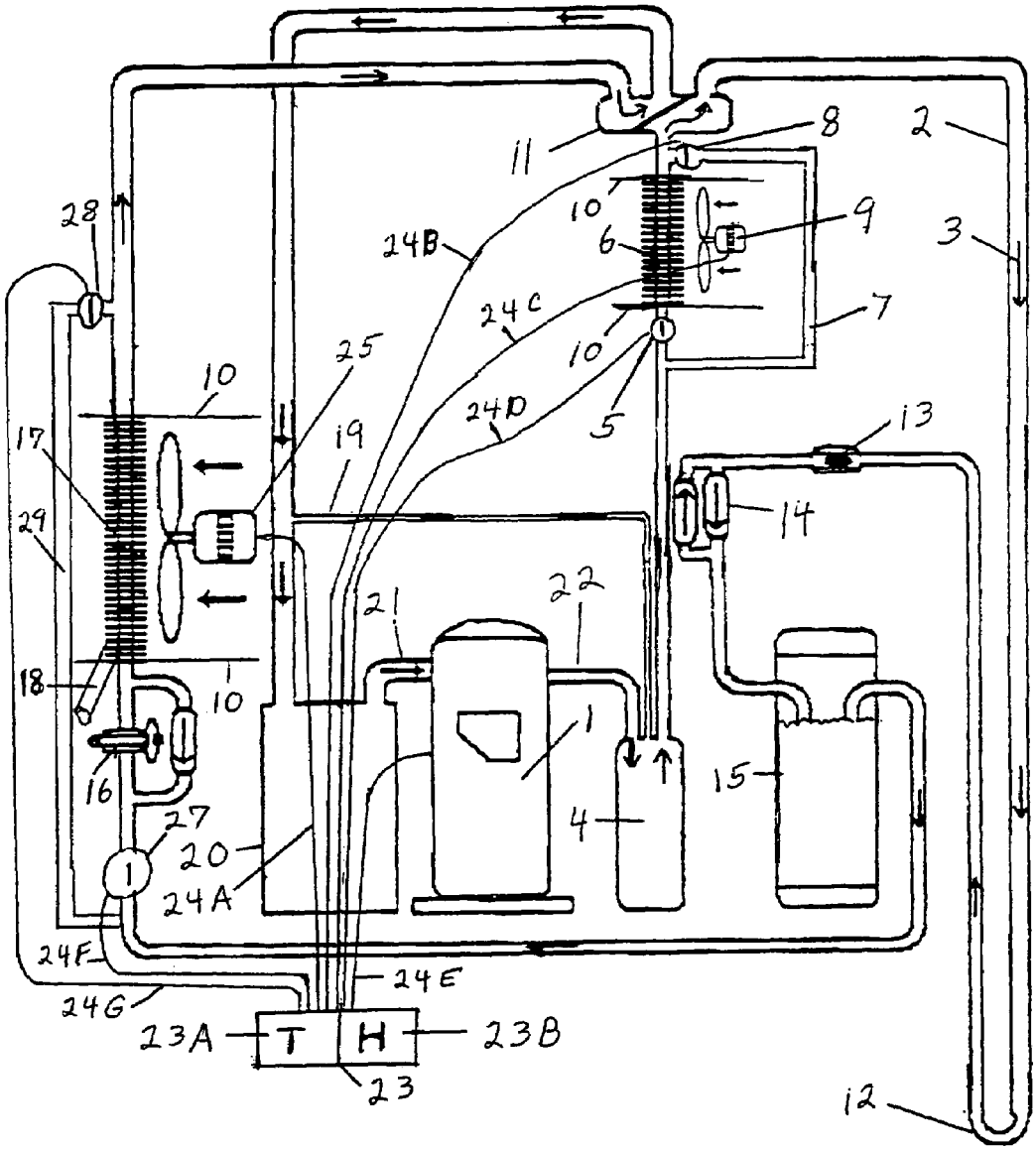
FIG. 3 is a side view of a deep well direct expansion heat pump system operating in the dehumidification mode, comprised of a compressor, a refrigerant (not shown as a refrigerant fluid flowing within the system is well understood by those skilled in the art), refrigerant transport lines, two interior air heat exchange means comprised of a first air handler and a second air handler, an exterior heat exchange means, and other system components common to a deep well direct expansion heat pump system. In this example, the second air handler is sized at 50% of the first air handler to enhance both heating and cooling mode operation efficiencies, and a by-pass refrigerant line is added around the first air handler for use in the heating mode of operation.

FIG. 3 is a side view of a simple version of a deep well direct expansion geothermal heat pump system, operating in a dehumidification mode.

A refrigerant fluid (not shown) is transported, by means of a compressor's 1 force and suction, throughout the system and to/from various system components by means of refrigerant transport tubing 2. The directional flow of the refrigerant fluid within the refrigerant transport tubing 2 is shown by arrows 3 within the tubing 2.

The refrigerant flows from the compressor 1 through an oil separator 4, through an open first solenoid valve 5, and then through the secondary interior air heat exchange means (secondary air handler with finned tubing) 6, where most of the heat within the refrigerant fluid is transferred back into the interior air (not shown). In the cooling only mode of operation, and not in the dehumidification mode, the first solenoid vale 5 would be closed (not shown here as closed) and the refrigerant would flow through the by-pass line 7 and around the secondary air handler with finned tubing 6, and through the second solenoid valve 8, which is alternately shown here in a closed position so as to reflect dehumidification mode operation. In an alternative means of cooling only mode of operation, the first and second solenoid valves, 5 and 8, and the by-pass refrigerant transport line 7 could be entirely eliminated and the secondary air handler's 6 fan 9 could simply be disengaged, with no electrical power supplied to operate it, thereby preventing any material airflow through the ductwork 10 containing the secondary air handler 6.

The refrigerant next flows through the system's reversing valve 11, and down into the sub-surface geothermal exterior heat exchange means 12. Exiting the exterior heat exchange means 12, which has absorbed the minor amount of heat generated by the system's compressor 1 and fan 9, the refrigerant flows past a pin restrictor expansion device 13, for use in the heating mode of operation, through an open check valve 14, through a receiver 15, and through a self-adjusting thermal expansion device 16. The refrigerant then flows through the system's primary and first interior air heat exchange means (first air handler) 17, where the interior air is sensibly cooled and where latent load humidity is removed. The condensed humidity is drained away by means of a condensate drain line 18.

Lastly, the refrigerant flows from the primary and first air handler 17, through the reversing valve 11, past the oil return line from the oil separator 4, into the accumulator 20, where any liquid refrigerant is collected so as not to slug the compressor 1. The vapor refrigerant within the accumulator 20, which has absorbed heat from the interior air passing through the system's first air handler 17, is pulled into the compressor by means of the compressor's suction intake. The refrigerant is compressed by the compressor 1, and exits the compressor 1 by means of the compressor's 1 hot gas refrigerant vapor discharge line 22, where the entire process is repeated for as long as operation in the dehumidification mode is called for. The wiring of a control box 23, containing a temperature control/thermostat 23A and a humidity control/humidistat 23B, to operate the system in one of the cooling mode and the dehumidification mode is well understood by those skilled in the art and is not shown herein in detail. However, a control connecting wire 24A is shown connecting the control box 23, containing a thermostat 23A and a humidistat 23B, with the first air handler's 17 fan 25; a control connecting wire 24B is shown connecting the control box 23 with the closed second solenoid valve 8; a control connecting wire 24C is shown connecting the control box 23 with the second air handler's 6 fan 9; a control connecting wire 24D is shown connecting the control box 23 with the open first solenoid valve 5; and a control connecting wire 24E is shown connecting the control box 23 with the system's compressor 1.

In this example, the second air handler 17 is sized at 50% of the first air handler 6 to enhance both heating and cooling mode operation efficiencies, and a secondary by-pass refrigerant transport line 29 is added around the first air handler 17 for use in the heating mode of operation. The secondary by-pass line 29 is operated by means of solenoid valves, 27 and 28. The solenoid valve 27, shown prior to the refrigerant flowing through the self-adjusting thermal expansion device 16, is in the open position so as to permit system operation in one of the cooling mode and the dehumidification mode. The solenoid valve 28, shown after the refrigerant has exited the first air handler 17, is in the closed position so as to prevent system operation in the heating mode. A control connecting wire 24F is shown connecting the control box 23 with the open third solenoid valve 5; and a control connecting wire 24G is shown connecting the control box 23 with the closed fourth solenoid valve 28. As is well understood by those skilled in the art, one reversing valve (not shown herein, but similar to the system's reversing valve 11), or the like, can be substituted for the two solenoid valves 27 and 28, and likewise, one reversing valve (not shown herein, but similar to the system's reversing valve 11) can be substituted for the two solenoid valves 5 and 8, with the same effect of by-passing the desired air handler for system operation in one of the cooling mode and heating mode, or of not by-passing either air handler, 6 and 17, for operation in the dehumidification mode.

Also, although not shown herein, the first air handler may be one of completely and mostly by-passed, while the system is operating in the heating mode, by various other alternative means other than by means of solenoid valves and a by-pass refrigerant transport line, as are well understood by those skilled in the art, such as, for example, by disengaging the first air handler's fan and thereby materially reducing the heat transfer over the first air handler's finned tubing.

Should one simply eliminate the solenoid valves 5,8,27, and 28, and eliminate the by-pass lines 7 and 29, and eliminate the reversing vale 11: one may selectively operate the system in the cooling mode by simply activating the fan 25 in the first air handler 17, and by deactivating/disengaging the fan 9 in the second air handler 6; one may selectively the system in the heating mode by simply deactivating/disengaging the fan 25 in the first air handler 17, and by activating the fan 9 in the second air handler 6; and one may selectively the system in the heating mode by simply activating the fan 25 in the first air handler 17, and by activating the fan 9 in the second air handler 6; all by means of the thermostat 23A and humidistat 23B control box 23, which can also control the desired CFM airflow in each of at least one desired operative air handler, 17 and 6.

What is claimed is:

1. A method of designing one of a heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means; and where the heat pump system's second interior air heat exchange means rejects heat into the interior air at a rate equal to the first interior air heat exchange means, less the rate equivalent to the additional heat of compression generated by means of the system's compressor.

2. The method of claim 1, where the system's first interior air heat exchange means, and not the system's second interior air heat exchange means, is operatively engaged during the system's cooling mode of operation.

3. The method of claim 2, where the system's second interior air heat exchange means is operatively disengaged in the cooling mode of operation by means of at least one of a solenoid valve and a check valve.

4. The method of claim 1, where the system's first interior air heat exchange means and the system's second interior air heat exchange means are both operatively engaged during the system's dehumidification mode of operation.

5. The method of claim 4, where the cooled interior air, provided by means of the first interior air heat exchange means, is mixed with the heated interior air, provided by means of the secondary interior air heat exchange means, for introduction into the interior air space.

6. The method of claim 4, where the system's second interior air heat exchange means is operatively engaged in the dehumidification mode of operation by means of at least one of a solenoid valve and a check valve.

7. The method of claim 1, where the heat pump system is comprised of at least one of a direct expansion heat pump system, a water source heat pump system, and an air source heat pump system.

8. The method of claim 1, where both the first interior air heat exchange means and the second interior air heat exchange means are respectively comprised of an air handler.

9. The method of claim 8, where both respective air handlers are comprised of at least one of single speed air handlers, multi-speed air handlers, and variable speed air handlers, and where both respective air handlers simultaneously operate at one of a concurrent desired multiple cubic feet per minute airflow speed, less the rate in the second interior air heat exchange means that is equivalent to the additional heat of compression generated by means of at least one of the system's compressor and externally powered components.

10. A method of designing one of a heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means;

where the system's first interior air heat exchange means and the system's second interior air heat exchange means are both operatively engaged during the system's dehumidification mode of operation where the system's first interior air heat exchange means, and not the system's second interior air heat exchange means, is operatively engaged during the system's cooling mode of operation;

where at least one of the system's cooling mode of operation and the at least one of a solenoid valve and a check valve is controlled by at least one of a thermostat and a humidistat; and where the system's humidistat's call for operation in the dehumidification mode is subject to, and will not override, the system's thermostat's call for operation in the cooling mode.

11. A method of designing one of a heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means;

where both the first interior air heat exchange means and the second interior air heat exchange means are respectively comprised of an air handler; and where the heat pump system's compressor is at least one of a single speed compressor, a multiple speed compressor, and a variable speed compressor, and where both respective air handlers operate at one of a concurrent desired lower speed when the compressor is operating at a lower speed, less the rate in the second interior air heat exchange means that is equivalent to the additional heat of compression generated by means of at least one of the system's compressor and externally powered components, and where both respective air handlers operate at one of a concurrent desired higher speed when the compressor is operating at a higher speed, less the rate in the second interior air heat exchange means that is equivalent to the additional heat of compression generated by means of at least one of the system's compressor and externally powered components.

12. A method of designing one of a heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means;

where both the first interior air heat exchange means and the second interior air heat exchange means are respectively comprised of an air handler; and where the first air handler's tonnage capacity is designed at a tonnage design capacity that is greater than the system's maximum compressor tonnage design capacity, and where the second air handler's tonnage capacity is designed at a tonnage design capacity that is one of equal to and less than the system's maximum compressor tonnage design capacity.

13. A method of designing one of a heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means;

where both the first interior air heat exchange means and the second interior air heat exchange means are respectively comprised of an air handler; and where the first air handler's tonnage capacity is designed at 200%, plus or minus 10% of 100%, of the system's maximum compressor tonnage design capacity, and where the second air handler's tonnage capacity is designed at 100%, plus or minus 10% of 100%, of the system's maximum compressor tonnage design capacity.

14. A method of designing one of a heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means;

where both the first interior air heat exchange means and the second interior air heat exchange means are respectively comprised of an air handler; and where the system's first air handler is one of by-passed, by means of a refrigerant transport tube, and is deactivated/disengaged, and is deactivated/disengaged by means of deactivating the first air handler's fan and reducing the first air handler's CFM airflow, while the system's second air handler is engaged and operative and the system is operating in the heating mode.

15. A heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means; and where the heat pump system's second interior air heat exchange means rejects heat into the interior air at a rate equal to the first interior air heat exchange means, less the rate equivalent to the additional heat of compression generated by means of the system's compressor.

16. The system of claim 15, where the system's first interior air heat exchange means, and not the system's second interior air heat exchange means, is operatively engaged during the system's cooling mode of operation.

17. The system of claim 16, where the system's second interior air heat exchange means is operatively disengaged in the cooling mode of operation by means of at least one of a solenoid valve and a check valve.

18. The system of claim 15, where the system's first interior air heat exchange means and the system's second interior air heat exchange means are both operatively engaged during the system's dehumidification mode of operation.

19. The system of claim 18, where the cooled interior air, provided by means of the first interior air heat exchange means, is mixed with the heated interior air, provided by means of the secondary interior air heat exchange means, for introduction into the interior air space.

20. The system of claim 18, where the system's second interior air heat exchange means is operatively engaged in the dehumidification mode of operation by means of at least one of a solenoid valve and a check valve.

21. The system of claim 15, where the heat pump system is comprised of at least one of a direct expansion heat pump system, a water source heat pump system, and an air source heat pump system.

22. The system of claim 15, where both the first interior air heat exchange means and the second interior air heat exchange means are respectively comprised of an air handler.

23. The system of claim 22, where both respective air handlers are comprised of at least one of single speed air handlers, multi-speed air handlers, and variable speed air handlers, and where both respective air handlers simultaneously operate at one of a concurrent desired multiple cubic feet per minute airflow speed, less the rate in the second interior air heat exchange means that is equivalent to the additional heat of compression generated by means of at least one of the system's compressor and externally powered components.

24. A heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means;

where the system's first interior air heat exchange means and the system's second interior air heat exchange means are both operatively engaged during the system's dehumidification mode of operation where the system's first interior air heat exchange means, and not the system's second interior air heat exchange means, is operatively engaged during the system's cooling mode of operation;

where at least one of the system's cooling mode of operation and the at least one of a solenoid valve and a check valve is controlled by at least one of a thermostat and a humidistat; and where the system's humidistat's call for operation in the dehumidification mode is subject to, and will not override, the system's thermostat's call for operation in the cooling mode.

25. A heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means;

where both the first interior air heat exchange means and the second interior air heat exchange means are respectively comprised of an air handler; and where the heat pump system's compressor is at least one of a single speed compressor, a multiple speed compressor, and a variable speed compressor, and where both respective air handlers operate at one of a concurrent desired lower speed when the compressor is operating at a lower speed, less the rate in the second interior air heat exchange means that is equivalent to the additional heat of compression generated by means of at least one of the system's compressor and externally powered components, and where both respective air handlers operate at one of a concurrent desired higher speed when the compressor is operating at a higher speed, less the rate in the second interior air heat exchange means that is equivalent to the additional heat of compression generated by means of at least one of the system's compressor and externally powered components.

26. A heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means;

where both the first interior air heat exchange means and the second interior air heat exchange means are respectively comprised of an air handler; and where the first air handler's tonnage capacity is designed at a tonnage design capacity that is greater than the system's maximum compressor tonnage design capacity, and where the second air handler's tonnage capacity is designed at a tonnage design capacity that is one of equal to and less than the system's maximum compressor tonnage design capacity.

27. A heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means;

where both the first interior air heat exchange means and the second interior air heat exchange means are respectively comprised of an air handler; and where the first air handler's tonnage capacity is designed at 200%, plus or minus 10% of 100%, of the system's maximum compressor tonnage design capacity, and where the second air handler's tonnage capacity is designed at 100%, plus or minus 10% of 100%, of the system's maximum compressor tonnage design capacity.

28. A heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means;

where both the first interior air heat exchange means and the second interior air heat exchange means are respectively comprised of an air handler; and where the system's first air handler is one of by-passed, by means of a refrigerant transport tube, and is deactivated/disengaged, and is deactivated/disengaged by means of deactivating the first air handler's fan and reducing the first air handler's CFM airflow, while the system's second air handler is engaged and operative and the system is operating in the heating mode.

29. A method of designing one of a heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means;

where the system's first interior air heat exchange means and the system's second interior air heat exchange means are both operatively engaged during the system's dehumidification mode of operation;

where at least one of the system's dehumidification mode of operation and the at least one of a solenoid valve and a check valve is controlled by at least one of a humidistat and a thermostat; and where the system's humidistat's call for operation in the dehumidification mode is subject to, and will not override, the system's thermostat's call for operation in the cooling mode.

30. A heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means;

where the system's first interior air heat exchange means and the system's second interior air heat exchange means are both operatively engaged during the system's dehumidification mode of operation;

where the system's second interior air heat exchange means is operatively engaged in the dehumidification mode of operation by means of at least one of a solenoid valve and a check valve;

where at least one of the system's dehumidification mode of operation and the at least one of a solenoid valve and a check valve is controlled by at least one of a humidistat and a thermostat; and where the system's humidistat's call for operation in the dehumidification mode is subject to, and will not override, the system's thermostat's call for operation in the cooling mode.

31. A heat pump dehumidification system and an improved efficiency interior air heat exchange means for an operative heat pump system, which heat pump system is comprised of at least a refrigerant, refrigerant transport tubing, a compressor, interior heat exchange means, and exterior heat exchange means, comprising providing a first interior air heat exchange means to withdraw heat from the interior air, situated between the system's exterior heat exchange means and the system's compressor's refrigerant gas/vapor intake point, and providing a second interior air heat exchange means to reject heat into the interior air, situated between the system's compressor's refrigerant gas/vapor discharge point and the system's exterior heat exchange means;

where the system's first interior air heat exchange means and the system's second interior air heat exchange means are both operatively engaged during the system's dehumidification mode of operation;

where at least one of the system's dehumidification mode of operation and the at least one of a solenoid valve and a check valve is controlled by at least one of a humidistat and a thermostat; and where the system's humidistat's call for operation in the dehumidification mode is subject to, and will not override, the system's thermostat's call for operation in the cooling mode.

* * * * *